US006045760A

United States Patent [19]

Aizawa et al.

[11] Patent Number: 6,045,760

[45] Date of Patent: Apr. 4, 2000

[54] MICRO-PLATE ADAPTER

[75] Inventors: Masaharu Aizawa; Masataka Morita; Yasuhiro Kawai; Iwao Yamazaki; Hiroshi Ono, all of Ibaraki, Japan

[73] Assignee: Hitachi Koki Co., Ltd., Tokyo, Japan

[21] Appl. No.: 08/756,911

[22] Filed: Nov. 26, 1996

[30] Foreign Application Priority Data

Dec. 5, 1995 [JP] Japan ..... 7-316545
Dec. 5, 1995 [JP] Japan ..... 7-316546

[51] Int. Cl.[7] ..... B01L 3/00

[52] U.S. Cl. ..... 422/104; 422/102

[58] Field of Search ..... 422/58, 69, 101, 422/102, 104; 436/177, 180, 809

[56] References Cited

U.S. PATENT DOCUMENTS

| | | | |
|---|---|---|---|
| 4,246,339 | 1/1981 | Cole et al. | 435/7 |
| 4,895,706 | 1/1990 | Root et al. | 422/102 |
| 5,141,719 | 8/1992 | Fernwood et al. | 422/101 |
| 5,219,528 | 6/1993 | Clark | 422/101 |
| 5,516,490 | 5/1996 | Sanadi | 422/101 |
| 5,650,125 | 7/1997 | Bosanquet et al. | 422/102 |
| 5,753,187 | 5/1998 | Reynolds et al. | 422/102 |

FOREIGN PATENT DOCUMENTS 57-934 1/1982 Japan .

OTHER PUBLICATIONS

Meyers, et al., "Multiple simultaneous synthesis of phenolic libraries," Molecular Diversity, 1 (1995), pp. 13–20.

*Primary Examiner*—Jill Warden
*Attorney, Agent, or Firm*—Sughrue, Mion, Zinn Macpeak & Seas, PLLC

[57] ABSTRACT

A micro-plate adapter for mounting a micro-plate onto a centrifugal separator rotor. The micro-plate has a sample injection hole portion containing a sample therein and as a box-like external wall. The adapter includes a bearing surface contacting a back bottom surface of the sample injection hole portion. A swing rotor for a centrifugal separator includes a rotor body attached to a driving shaft of the centrifugal separator and provided with a plurality of bucket storage portions; buckets all swingably engaged with the rotor body in the respective storage portions so that samples stored in the buckets are subjected to centrifugal separation by a centrifugal force generated by rotation of the swing rotor. Each of the buckets is formed to have a shape which adapts with a bottom surface of a micro-plate so as to contact with the back bottom surface of a sample injection hole portion of the micro-plate to bear a centrifugal load of the micro-plate. The swing rotor further includes a shell enclosing the rotor body and the buckets so as to rotate together with the rotor body and the buckets.

7 Claims, 7 Drawing Sheets

MICRO-PLATE ADAPTER

BACKGROUND OF THE INVENTION

1. Field of the Invention

The present invention relates to a swing rotor for a centrifugal separator, a micro-plate adapter for mounting a micro-plate including a sample onto the swing rotor for a centrifugal separator, and a method for centrifugal separation.

2. Description of the Related Art

First, a micro-plate will be described with reference to FIG. 1. A micro-plate 4 is used in a manner such that it is put into a centrifugal separator after an active reagent has been dropped on a body fluid such as blood, or it is used for various experiments in a tissue culture field or a genetic engineering field including a centrifuge separation process as an intermediate step. Such a micro-plate 4 is generally formed by molding with plastic material such as polystyrene or polypropylene. The micro-plate 4 is a box-like vessel about 130 mm long, about 90 mm wide and about 10 to 50 mm high, and a large number of small concave sample injection hole portions 5 for injecting a sample are provided so as to be regularly aligned vertically and horizontally in the upper surface portion thereof. A notch portion 8 is provided in the lower portion of a box-like external wall 7 of the micro-plate 4 in consideration of laying on another micro-plate 4. The size of this notch portion 8 is substantially corresponding to the size of the upper surface portion of the micro-plate 4 so as to prevent positional displacement from occurring when such micro-plates 4 are laid on each other. If this notch portion 8 is not provided in a position lower than a plate bottom surface 9 of the micro-plate 4, it is impossible to prevent the positional displacement when such micro-plates 4 are laid on each other. Therefore, the box-like external wall 7 of the micro-plate 4 is extended to a position lower than a plate bottom surface 9.

Next, a rotor for a centrifugal separator for centrifuging the above-mentioned sample in the micro-plate 4 will be described. Such a rotor for a centrifugal separator is disclosed in, for example, Japanese Utility Model Examined Publication No. Sho 57-934, and it will be described here with reference to FIGS. 2 and 3. FIG. 2 is a perspective view of the appearance of a swing rotor, and FIG. 3 is a perspective view of the appearance of a metal adapter mounted on the swing rotor of FIG. 2. In FIG. 2, the rotor is constituted by a rotor body 1 and a bucket 2. A rotation force is given to the rotor body 1 by a not-shown centrifugal separator, and the bucket 2 swings outward by a centrifugal force caused by this rotation force so as to give centrifugal acceleration to a sample held in the bucket 2.

To use such a swing rotor for separating a sample contained in the micro-plate 4, generally, a metal adapter 3 is mounted on the bucket 2. The adapter 3 has an outer size so as to be held by the bucket without looseness, and further has bent portions 12 and 13 for holding the outer circumference of the micro-plate 4 in order to eliminate looseness between the adapter 3 and the micro-plate 4 when the adapter 3 holds the micro-plate 4. The adapter 3 is manufactured by finishing a metal plate such as a stainless steel plate or an aluminum plate, and a bottom portion 11 thereof is made flat.

FIG. 1 shows the structure in which the aforementioned micro-plate 4 is mounted on the adapter 3. As mentioned above, the box-like external wall 7 of the micro-plate 4 is extended to a position lower than the plate bottom surface 9, and the bottom portion 11 of the adapter 3 is made flat, so that there is a gap portion 10 between the micro-plate 4 and the adapter 3. In such a state, the adapter 3 is usually used at the rotational speed of about 2,000 rpm, and the maximum centrifugal acceleration of 700 Xg.

Therefore, conventional rotors available on the market have the maximum rotational speed of 2,000 rpm and the maximum centrifugal acceleration of about 600 to 800 Xg, which belongs to a range in which no damage occurs in micro-plates.

As the usage and field of application intended by the present invention, it is directed to the improvement of efficiency in studies relating to DNA or RNA which has been studied prosperously in a genetic engineering field and so on. Centrifugal separation of the DNA as a sample is one of important processes in the procedure of DNA sequencing in such a field. Particularly in DNA recovery methods through ethanol precipitation performed by adding a proper quantity of ethanol or the like to a solution including DNA, a higher recovery percentage has been desired. The recovery percentage, however, was about 75% with a conventional rotor having the maximum rotational speed of 2,000 rpm, and the maximum centrifugal acceleration of about 600 to 800 Xg.

In order to increase this recovery percentage, it is necessary to perform separation under a higher centrifugal acceleration, and therefore centrifugal separation has been performed at the rotational speed of about 12,000 rpm (about 10,000 Xg) for about 10 minutes by using a plastic micro-tube (test tube) of about 0.2 ml to 2 ml.

However, since micro-tubes are handled one by one in this operation, the operation is troublesome. Further, since micro-tubes not micro-plates are used, only about 48 tubes at maximum can be treated in one driving because of the limitation of an apparatus in centrifugal separation.

Recently, various inspections of symptoms about the health of human bodies or experiments in a tissue culture field have been performed with a micro-plate flourishingly, and it is necessary to improve the efficiency in centrifugal separation process required in an intermediate process of the inspections or experiments. The improvement of the efficiency in a centrifugal separation process can be attained by increasing the rotational speed of a rotor to thereby increase the centrifugal acceleration.

However, if the rotational speed of the rotor structured as above thus is increased to improve the efficiency, a group of the sample injection hole portions 5 of the micro-plate 4 are broken due to collapse from a border portion 6 between the group of the sample injection hole portions 5 and the box-like external wall 7. Thus the desired separation, cannot be attained. Because the gap portion 10 exists between the plate bottom portion 9 of the micro-plate 4 and the bottom portion 11 of the adapter 3 when a centrifugal load caused by the centrifugal acceleration is given to the micro-plate 4, the sample injection hole portions 5 are bent to the gap portion 10 side by the centrifugal load. As a result of the centrifugal loud a large bending moment is given to the border portion 6 between the group of the sample injection hole portions 5 and the box-like external wall 7, so that the border portion 6 is broken. According to experiments effected by the present applicant, ordinary micro-plates 4 available on the market were examined, and as a result, the border portion 6 was broken at about 1,000 Xg (1,000 times as high as the gravitational acceleration). Generally, polystyrene is often used as the material for the micro-plate 4. However none of the reasons for the above-mentioned damage is that polystyrene is weak in the property of strength.

Since a rotor for a centrifugal separator generates high centrifugal acceleration, the lighter a subject to be separated including the adaptor 3 held by the bucket 2 is, the smaller the centrifugal load can be made, and it is therefore advantageous to reduce the burden of the rotor body and the bucket. In addition, buckets are disposed symmetrically with respect to the rotation axis, so that it is necessary to consider the mass balance of opposite buckets and the position balance of the center of gravity thereof. If the micro-plate is held and rotated in a state in which it is displaced in position, the rotor rotates while vibrating greatly so that the centrifugal separator may be broken to make it impossible to attain the desired centrifugal separation.

SUMMARY OF THE INVENTION

The present invention has been made in view of the above, and therefore an object of the present invention is to improve the efficiency a centrifugal separation process so that a rotor for a centrifugal separator mounted with a current micro-plate can be used at high centrifugal acceleration.

Another object of the present invention is to improve the efficiency in a centrifugal separation process by making a current micro-plate or a micro-plate-like collective of microtubes usable under high centrifugal acceleration.

In order to solve the above problems, according to one aspect of the invention, there is provided an adapter which has a bearing surface contacting with a back bottom surface of a sample injection hole portion of a micro-plate. That is, a plate bottom surface is formed so as to bear a centrifugal load of the micro-plate. The circumference of the bearing surface portion is made thin enough to thereby float the bottom surface portion of a box-like external wall of the micro-plate.

In the adapter configured, according to the present invention the bearing surface is provided so that there is no gap between the plate bottom surface of the micro-plate and the adapter. Accordingly, there is no danger that the sample injection hole portion is bent, or that a large bending moment is given to a border portion between a group of sample injection hole portions and the box-like external wall. Thus with the configuration of the present invention it is possible to prevent the border portion from being damaged.

According to another aspect of the invention, there is provided a swing rotor for a centrifugal separator comprising a rotor body attached to a driving shaft of the centrifugal separator and provided with a plurality of bucket storage portions, and buckets and engaged with the rotor body swingably, provided in the respective storage portions, whereby samples stored in the buckets are subjected to centrifugal separation by a centrifugal force generated by rotation of the swing rotor, characterized in that each of the buckets is formed to have a shape which adapts with a bottom surface of a micro-plate so as to contact with the back bottom surface of a sample injection hole portion of the micro-plate to bear a centrifugal load of the micro-plate, the swing rotor having a shell enclosing the rotor body and the buckets so as to rotate together with the rotor body and the buckets.

The above and other objects and features of the present invention will be more apparent from the following description taken in conjunction with the accompanying drawings.

DETAILED DESCRIPTION OF THE PREFERRED EMBODIMENTS

A description will be given in more detail of preferred embodiments of the present invention with reference to the accompanying drawings.

Figure 4:
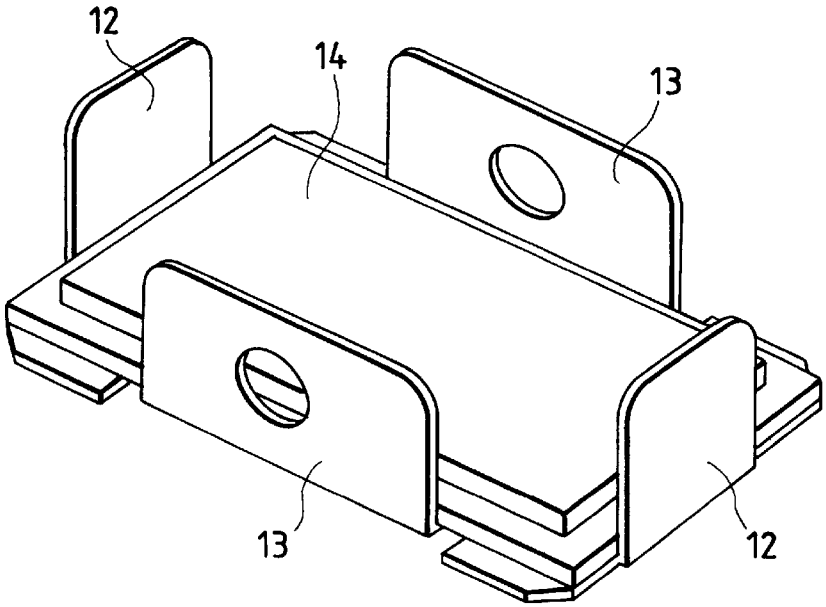
FIG. 4 is an appearance perspective view illustrating an adapter showing a first embodiment of the present invention.

An adapter for a micro-plate according to an embodiment of the present invention will be described with reference to FIGS. 4 and 5. FIG. 4 is a perspective view of the appearance of an adapter 3 showing an embodiment of the present invention, and FIG. 5 is a vertically sectional side view in which the adapter 3 of FIG. 4 is combined with a micro-plate 4.

In the drawings, a pad 14 having an outer size substantially equal to the inner size of the adapter 3 is installed in the adapter 3. The pad 14 is formed of elastic material such as rubber or plastic, and bonded with the adapter 3 at its bottom portion. The pad 14 has an upper surface portion 16 high enough to contact with a plate bottom surface 9 of the micro-plate 4 in its center portion, and a step portion 15 high enough to contact with the lower surface of a box-like external wall 7 of the micro-plate 4 at its outer circumference portion.

Figure 5:
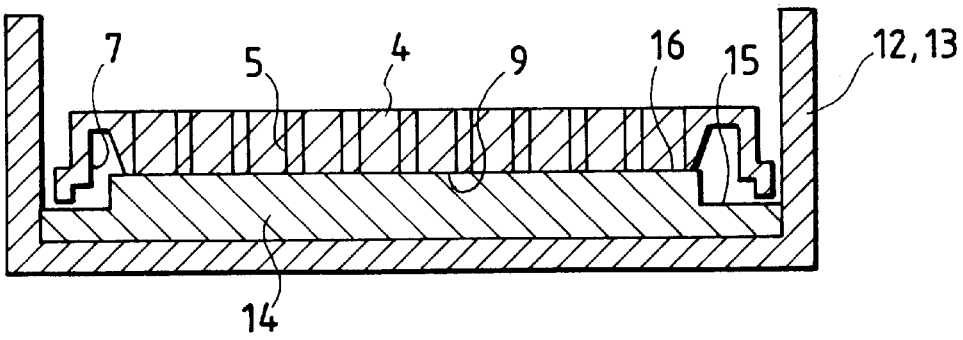
FIG. 5 is a vertical sectional side view showing a state in which the adapter is-combined with a micro-plate.

When the micro-plate 4 is mounted on the adapter 3 to which the pad 14 configured according to present invention is attached, and installed in a bucket 2 of a rotor body 1 to perform centrifugal separation, the bucket 2 including the adapter 3 swings due to a centrifugal force so as to generate a centrifugal force which acts downward in FIG. 5. While this centrifugal force acts on the micro-plate 4, the plate bottom surface 9 of the micro-plate 4 is received in the centrifugal direction by the upper surface portion 16 of the pad 14. Further the box-like external wall 7 of the micro-plate 4 is received by the step portion 15 of the pad 14. As a result of the above configuration a large bending moment is not given to a border portion 6 between a group of sample injection hole portions 5 and the box-like external wall 7 and any other portion. As a result, the adapter 3 can endure a centrifugal force higher than a conventional one. Micro-plates 4 available on the market were subjected to rotation examination by use of the adapter 3 configured according to the present invention. As a result, centrifugal acceleration up to 2,000 Xg could be given without any problem, and it was confirmed that the adapter 3 could endure the centrifugal acceleration twice as high as that of a conventional adapter.

Although the pad 14 is designed so as to be bonded to the adapter 3 in this embodiment, it is apparent that the same effect can be obtained also in a structure in which the pad 14 is simply placed on adapter so that the pad 14 is used in the case where the micro-plate 4 is attached to a centrifugal separator, but it is removed in the case where any other thing is attached to the centrifugal separator. In addition, although the pad 14 is formed separately from the adapter 3 in this embodiment, the same effect can be obtained also in the case where the bottom portion 11 of the adapter 3 is shaped like the aforementioned pad 14.

Figure 6:
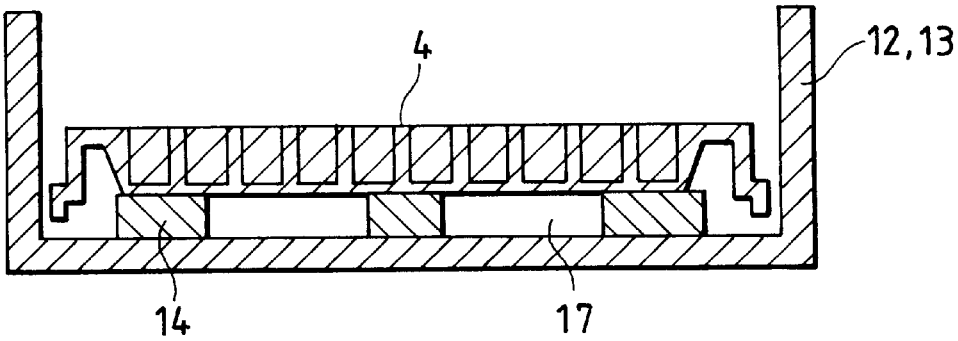
FIG. 6 is a vertical sectional side view showing a state in which an adapter showing a second embodiment of the present invention is combined with a micro-plate.

Next, a second embodiment of a micro-plate adapter according to the present invention will be described with reference to FIG. 6. Since the adapter 3 is installed in the bucket 2 of the rotor body 1 in use as mentioned above, the lighter the adaptor 3 is, the smaller the centrifugal force acting on the rotor body 1 can be made, advantageously. It is therefore preferable that the pad 14 shown as the first embodiment in FIGS. 4 and 5 is made lighter. For this reason, a pad 14 having a thin portion 17 is bonded to the adapter 3 in the second embodiment shown in FIG. 6. Since the thin portion 17 is formed for reducing the mass of the adapter 3, there are various ways to make the portion thin so long as no damage is caused by the bending moment of the micro-plate 4. By the effect of this thin portion 17, a portion which receives the plate bottom surface 9 of the micro-plate 4 and a portion which does not receive it are formed, and the bending moment is given between those portions. The portion which does not receive the plate bottom surface 9 is however smaller than the conventional one, so that the adapter 3 can endure a centrifugal force higher than the conventional one. In addition, although the box-like external wall 7 of the micro-plate 4 is not received by the pad 14 in the structure shown in FIG. 6, the weight of the box-like external wall 7 is smaller than the portion near the sample injection hole portion 5 to which a sample has been injected. Therefore, the centrifugal acceleration on the box-like external wall 7 is smaller than the portion near the sample injection hole portion 5, so that damage is hardly generated in the border portion 6 which might been produced in the conventional structure.

Figure 7:
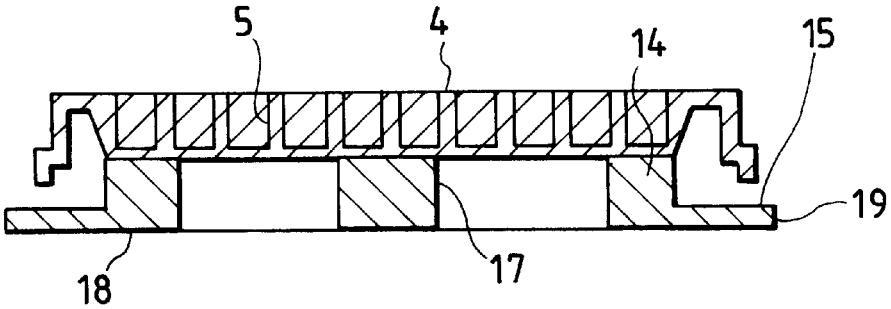
FIG. 7 is a vertical sectional side view showing a third embodiment of the present invention.
Figure 8:
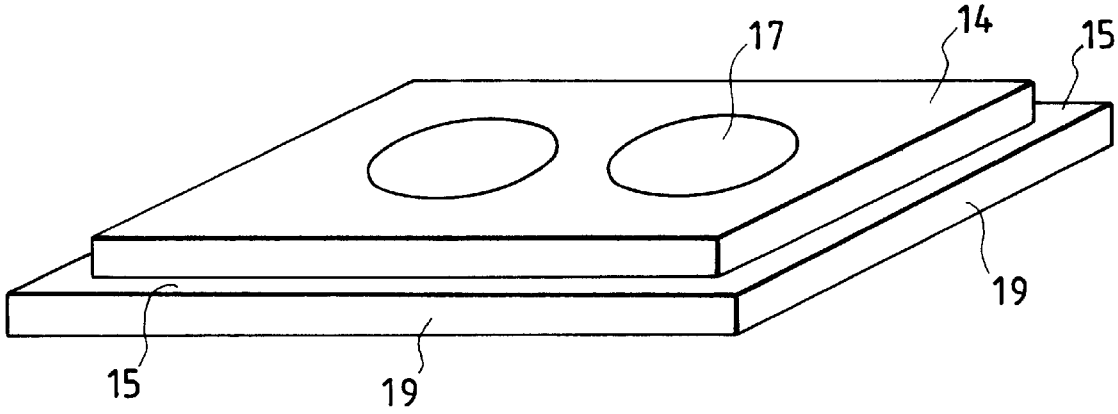
FIG. 8 is an appearance perspective view illustrating the adapter of FIG. 7.

Next, a third embodiment of a micro-plate adapter 3 according to the present invention will be described with reference to FIGS. 7 and 8. The third embodiment is different from the above-mentioned second embodiment in the point that a step portion 15 is provided in the outer circumferential portion of the pad 14. A pad side surface 19 which is the outer circumferential surface of the step portion 15 is made equal to or slightly larger than the inner size of the adapter 3. Therefore, the pad 14 can be fixedly positioned to the adapter 3 by the pad side surface 19 in the third embodiment so that it is not necessary to bond them with each other while the pad 14 is bonded to the adapter 3 of the second embodiment. In addition, the box-like external wall 7 of the micro-plate 4 is not received by the pad 14 also in the third embodiment. The reason for this is the same as in the second embodiment.

Figure 9:
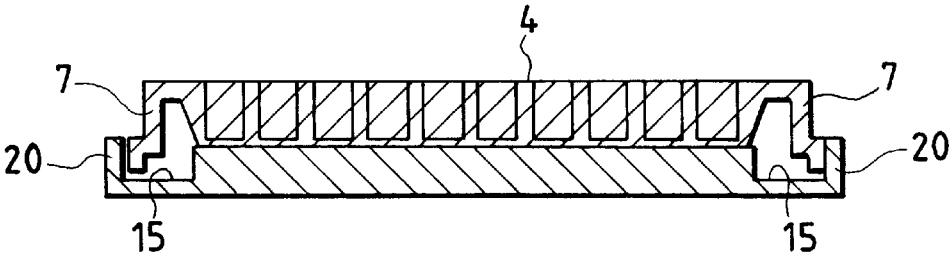
FIG. 9 is a vertical sectional side view showing a fourth embodiment of the present invention.

Next, a fourth embodiment of a micro-plate adapter according to the present invention will be described with reference to FIG. 9. The fourth embodiment is largely different from the first embodiment in that a plate pressing portion 20 is provided in the pad 14. The plate pressing portion 20 is to restrict the relative movement between the pad 14 and the micro-plate 4 so that the micro-plate 4 can be put in a predetermined place on the pad 14 more surely. In addition, although FIG. 9 shows structure in which the plate pressing portion 20 presses the outer circumference of the micro-plate 4, the plate pressing portion 20 may be designed so as to press the inside of the box-like external wall 7 of the micro-plate 4.

Figure 10:
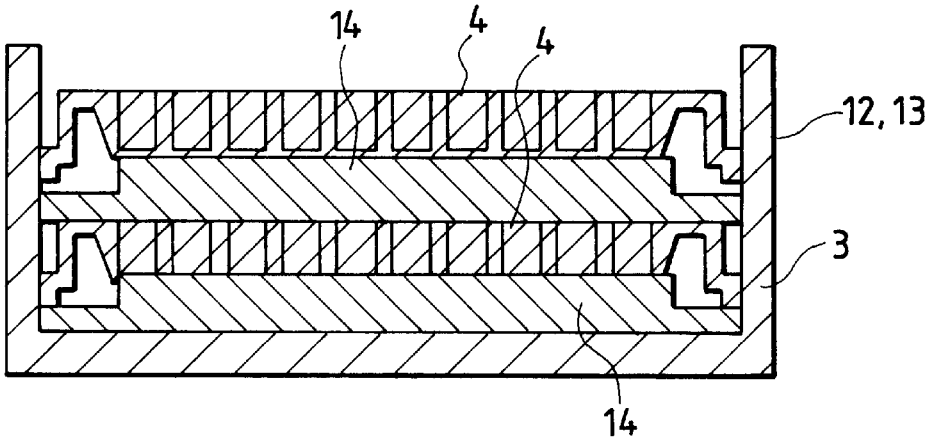
FIG. 10 is a vertical sectional side view showing a fifth embodiment of the present invention.

Next, a fifth embodiment of a micro-plate adapter according to the present invention will be described with reference to FIG. 10. When the adapter 3 is formed separately from the pad 14, the adapter 3 can be put in a centrifugal separator in a state where micro-plates 4 are laid on each other. As shown in FIG. 10, a pad 14 as mentioned above is mounted on the bottom portion of the adapter 3, and then a micro-plate 4 is put thereon. If another pad 14 is further put on the micro-plate 4, a second micro-plate 4 can be put thereon.

Figure 11:
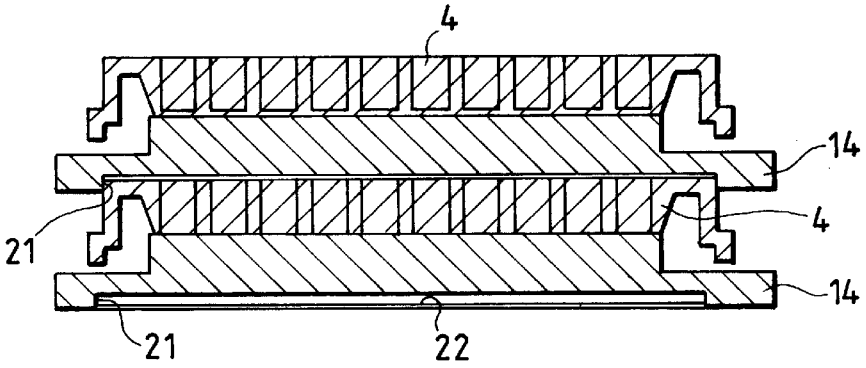
FIG. 11 is a vertical sectional side view showing a sixth embodiment of the present invention.

Next, a sixth embodiment of a micro-plate adapter according to the present invention will be described with reference to FIG. 11. FIG. 11 is a modification of the pad 14 shown in FIG. 10. A pad 14 shown in FIG. 11 has a pad concave portion 21 in the lower surface of the pad 14. The pad concave portion 21 is substantially equal in size to the upper surface of the micro-plate 4. FIG. 11 shows the state where micro-plates 4 are laid on each other by use of the pad 14 configured in a similar manner as the fifth embodiment. As is apparent from the structure shown in FIG. 11, the pad 14 put on the micro-plate 4 holds the upper surface of the micro-plate 4 by means of the pad concave portion 21 thereof so as to restrict the relative movement between the pad 14 and the micro-plate 4. When the pad 14 having such a pad concave portion 21 is put on the adapter 3, a gap portion 22 is produced between the pad 14 and the adapter 3 because the bottom portion 11 of the adapter 3 is flat. When the adapter 3 having this gap portion 22 produced between the pad 14 and the adapter 3 is put in a centrifugal separator, a bending moment is generated in the pad concave portion 21 by the centrifugal acceleration. However, the bending moment can be absorbed by the elastic force of the pad 14 itself if the pad 14 is formed of elastic material such as rubber. In addition, in order to eliminate the gap portion 22, the bottom portion of a pad 14 to be put in the lowest position may be made flat (as shown, for example, in FIGS. 4 to 10), while another pad 14 to be put on a micro-plate 4 has a pad concave portion 21.

Figure 12:
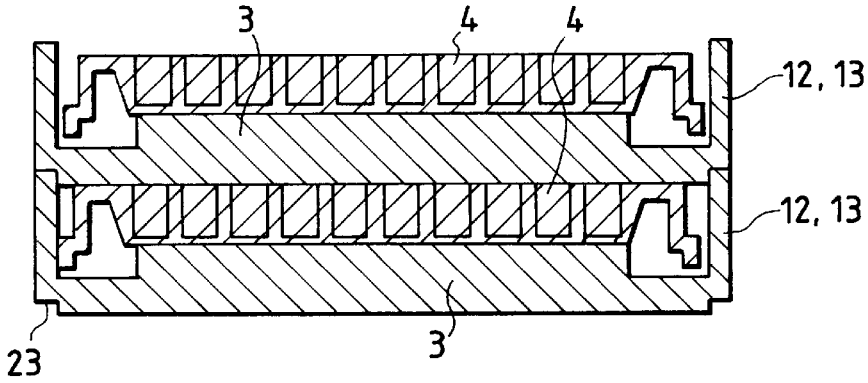
FIG. 12 is a vertical sectional side view showing a seventh embodiment of the present invention.

Next, a seventh embodiment of a micro-plate adapter according to the present invention will be described with reference to FIG. 12. In FIG. 12, the shape of the bottom surface of the adapter 3 is made similar to the shape of the upper surface of the above-mentioned pad 14 so that the plate bottom surface 9 of the micro-plate 4 is received directly by the adapter 3. Further, engagement grooves 23 having the same width as the bent portions 12 and 13 of the adapter 3 are provided in the lower end of the bent portions 12 and 13 so that the adapter 3 can be put in a centrifugal separator in the state where micro-plates 4 are laid on each other. Although the adapter 3 is configured as described above in this embodiment, not the adapter 3 but the pad 14 may be configured in the manner as mentioned above so that the pad 14 may be installed to the adapter 3.

Figure 16:
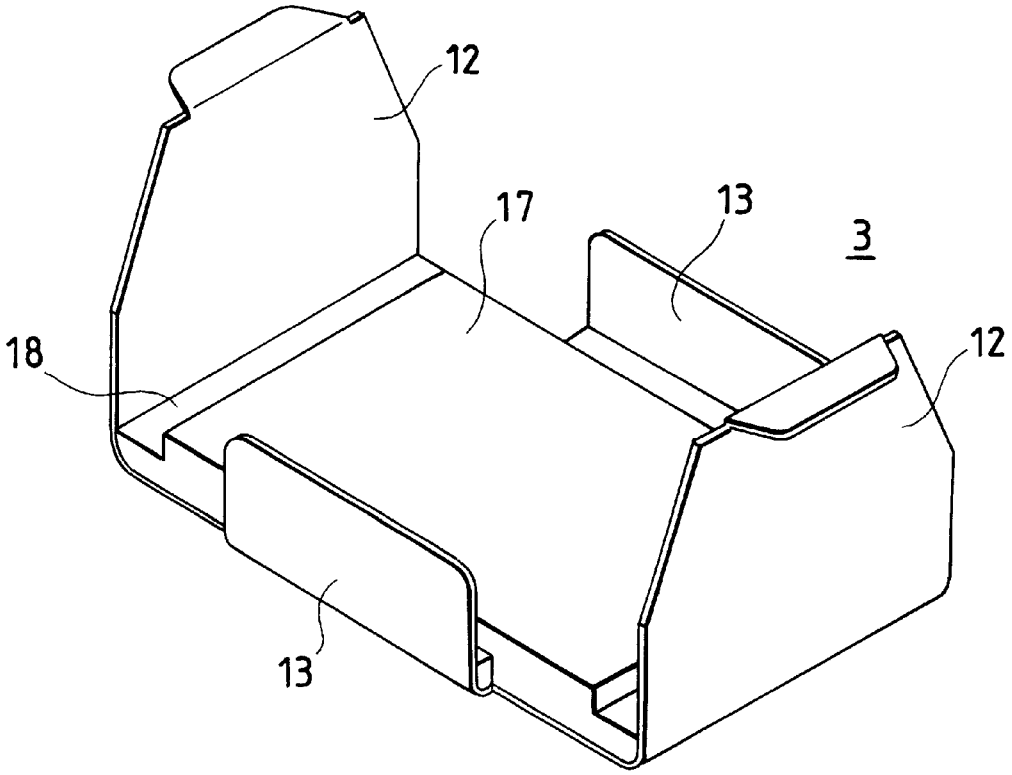
FIG. 16 is a perspective appearance view showing an adapter mounted on the rotor of FIG. 13.
Figure 17:
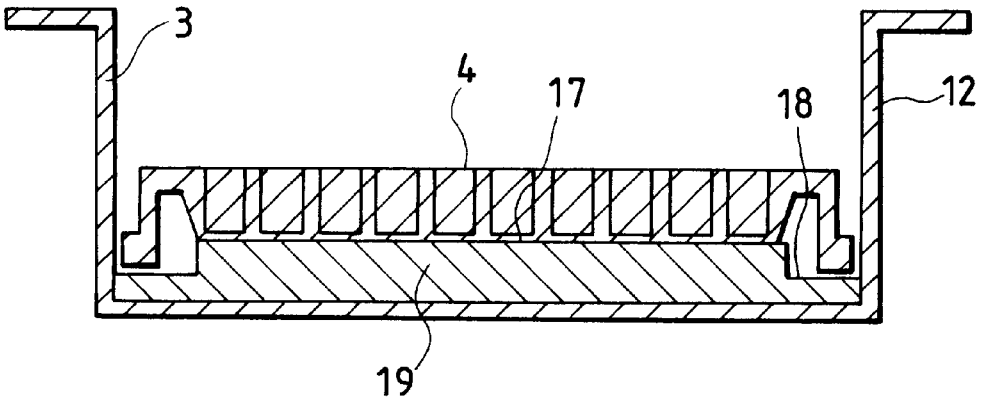
FIG. 17 is a sectional view showing a modification of the adapter of FIG. 16.

Subsequently, the structure of an adapter 3 for holding a micro-plate will be described with reference to FIGS. 16 and 17. FIG. 16 is a perspective view illustrating the appearance of the adapter 3 installed in a rotor shown in FIG. 13. Bent portions 12 and 13 for supporting the outside of a micro-plate 4 are provided in the adapter 3, and a bearing surface 17 contacting with the back bottom surface of the micro-plate 4 and a step portion 18 to which a box-like external wall 7 of the micro-plate 4 enters are provided on bottom surface of the adapter 3. It is not always necessary to configure the adapter 3 itself in such a manner as shown in FIG. 16, but, alternatively, a pad 19 having a bearing surface 17 and a step portion 18 may be put on a conventional adapter having a flat bottom portion. To manufacture the adapter 3, there are various methods, such as a method where the bent portions 12 and 13 are produced by bending a metal plate and the pad 19 is formed of rubber or plastic material and bonded therewith, a method where the adapter 3 as a whole is molded of plastic material, and so on.

Figure 13:
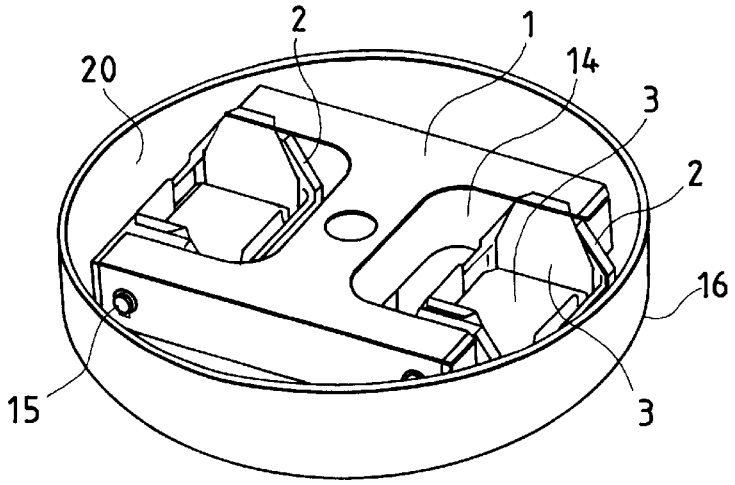
FIG. 13 is a perspective appearance view showing an eighth embodiment of the present invention.

A swing rotor for a centrifugal separator having such an adapter 3 as configured according to the present invention will be described with reference to FIG. 13. FIG. 13 is a perspective view illustrating the appearance of a swing rotor of an eighth embodiment according to the present invention. In FIG. 13, a rotor body 1 has bucket storage portions 14 disposed in two places. A bucket 2 is attached to each of the bucket storage portions 14 through a pin 15 swingably mounted with respect to the rotor body 1. The adapter 3 for holding the micro-plate 4 is inserted into each bucket 2 from above. Further, a shell 16 is attached so as to enclose an assembly of the rotor body 1 and the buckets 2. The size of the shell 16 is defined so that the top ends of the respective buckets 2 do not contact with the shell 16 when the buckets 2 swing. The shell 16 is formed integrally with the rotor body 1 on the lower side, and has no roughness in its outer circumferential surface so as to minimize windage loss at the time of rotation of the rotor body 1. Further, the shell 16 has an aperture portion 20 in its upper portion for easily removing/attaching the micro-plate 4. The rotor body 1, the buckets 2 and the shell 16 are formed of an aluminum alloy and finished and shaped. It is matter of course that plastic material or composite material may be used for these parts so long as its strength is allowable.

When the swing rotor for a centrifugal separator thus configured is rotatably driven by a not-shown centrifugal separator, the windage loss is reduced extremely in the outer circumferential portion of the rotor where the highest windage loss arises so that it is possible to rotate the swing rotor in a higher rotational speed, in comparison with a conventional structure without providing the shell 16.

Figure 14:
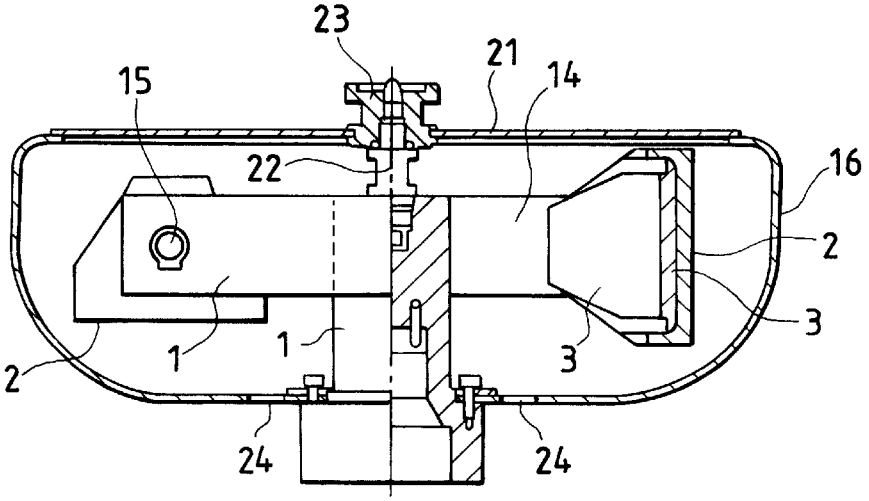
FIG. 14 is a vertically sectional view showing a ninth embodiment of the present invention.
Figure 15:
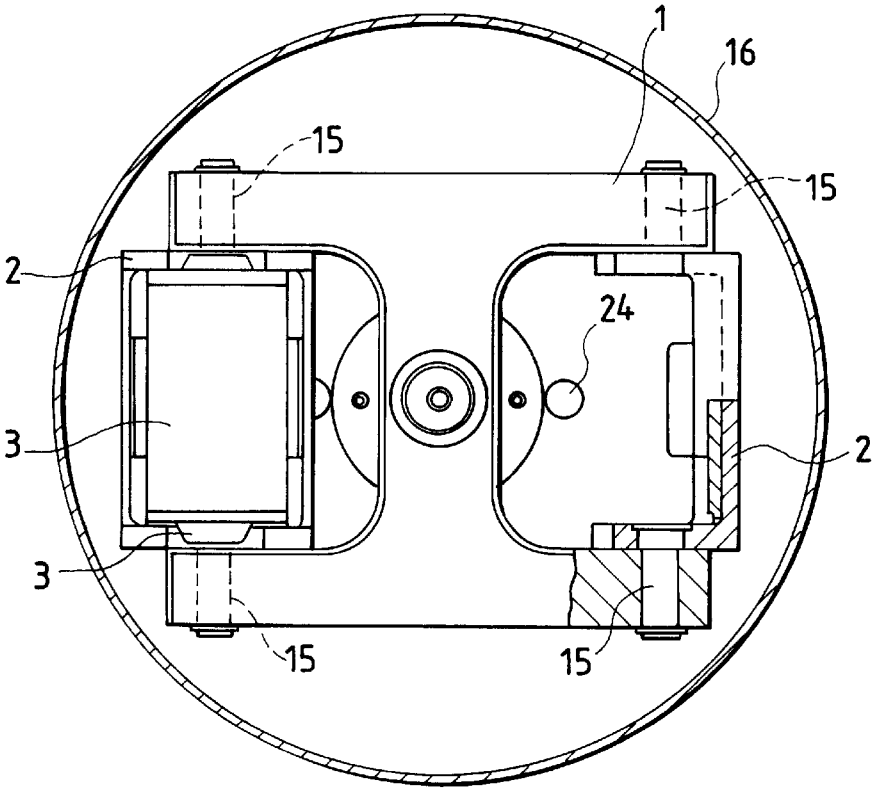
FIG. 15 is a top view showing the section of FIG. 14.

If the aperture portion 20 of the shell 16 shown in FIG. 13 is closed, the windage loss can be reduced even more. FIG. 14 shows an example in which the aperture portion 20 is closed by a cover 21. FIG. 14 is a vertically sectional view illustrating a swing rotor of a ninth embodiment where in, the left half of FIG. 14 shows the state in which the rotor is standing still, the right half of FIG. 14 shows the state in which the rotor is rotating. FIG. 15 is a top view in section of FIG. 14.

In the structure of FIG. 14, a center pin 22 is fixed to the center of the rotor body 1 of the swing rotor shown in FIG. 13 by screwing, bonding or the like, and a cover 21 having an engagement member 23 engaging with this center pin 22 is attached. The cover 21 is removably attached to the shell 16. The cover 21 is removed from the shell 16 when the micro-plate 4 is to be attached/removed, and attached to the shell 16 during centrifugal separation. The swing rotor configured thus can reduce windage loss at its upper surface in comparison with the swing rotor shown in FIG. 13 so as to make it possible to rotate the swing rotor at a higher rotational speed.

Figure 1:
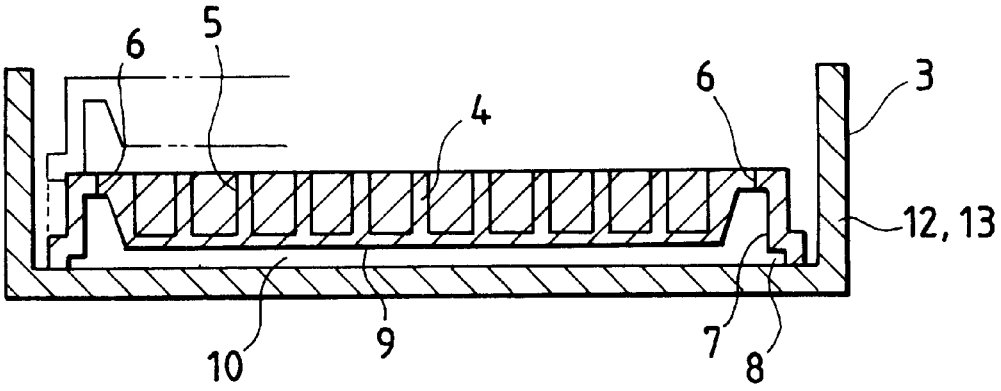
FIG. 1 is an appearance perspective view illustrating a conventional rotor.
Figure 2:
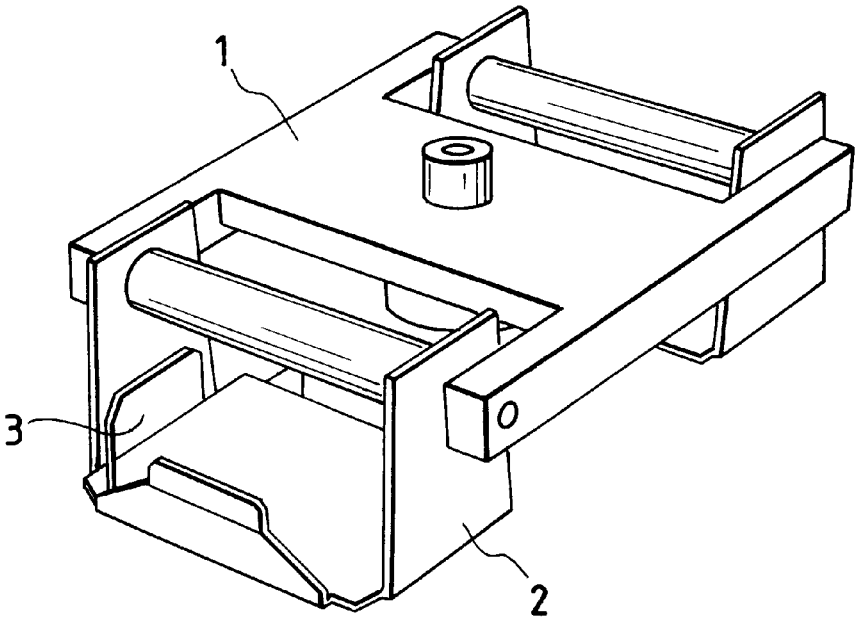
FIG. 2 is an appearance perspective view illustrating a conventional adapter.
Figure 3:
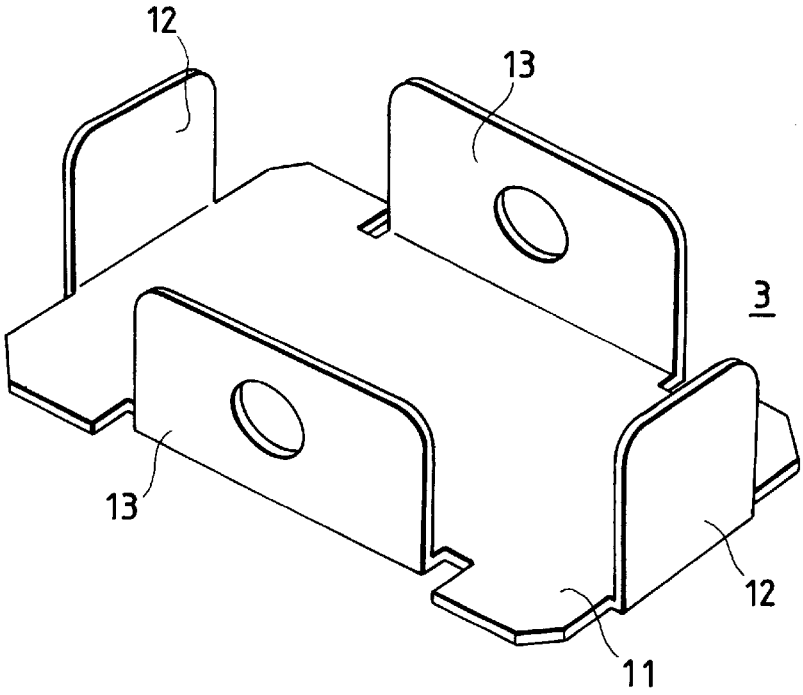
FIG. 3 is a vertical sectional side view showing a micro-plate held by the conventional adapter.

Hole portions 24 are formed in the bottom portion of the shell 16 of each of the swing rotors shown in FIGS. 13 and 2. When rotation is started without attaching the cover 21 in the swing rotor shown in FIG. 13 or FIG. 14, the air in the shell 16 is discharged outside the shell 16 by a centrifugal force. Then, the density of the air in the shell 16 becomes low, while the density of the air outside the shell becomes high. That is, there arises a difference in air density (difference in pressure) between the inside and outside of the shell 16, and a force to lift the whole of the swing rotor upward in the state as shown in FIG. 14 is generated by this difference. If the rotor is lifted up, the engagement with a driving portion of the not-shown centrifugal separator is released very dangerously. To avoid this situation, the hole portions 24 are formed in the bottom portion of the shell 16 to eliminate the difference in air density between the inside and outside of the shell 16. Since the air flows from the outside to the inside of the shell 16 through these hole portions 24, it is not preferable to provide the hole portions 24 in the outer circumferential side of the rotor acting to discharge the air out of the shell 16 to the outside by a centrifugal forcer but it is preferable to provide near the axis of rotation.

Practical use of the swing rotor for a centrifugal separator configured thus will be described. Micro-plates available on the market were subjected to rotation examination by use of the swing rotor for a centrifugal separator configured as shown in FIG. 14. As a result, it was possible to rotate the swing rotor up to 5,700 rpm and 5,000 Xg without any problem. By this, it was confirmed that the rotor could endure centrifugal acceleration about six times as large as a conventional rotor.

A real effect of centrifugal separation was also examined. DNA recovery experiments were performed by ethanol precipitation method based on a lambda DNA solution (32 g/ml) which was DNA of lambda phage. By changing the centrifugal rotational speed in recovery (centrifugal time was constant, that is, 10 minutes), the influence of the rotational speed to the recovery percentage of DNA was examined. The recovery percentage was about 75% at the rotational speed of 2,000 rpm (the maximum centrifugal acceleration was 620 Xg), and the recovery percentage was about 80% in the number of rotations of 3,000 rpm (the maximum centrifugal acceleration was 1,390 Xg). On the other hand, the recovery percentage was about 100% at the rotational speed of 5,700 rpm (the maximum centrifugal acceleration was 5,010 Xg).

It was understood that a high rotational speed makes the recovery percentage high, and the recovery percentage of DNA is 100% at the maximum centrifugal acceleration of 5,000 Xg or more. From this, if a micro-plate is installed in the swing rotor for a centrifugal separator according to the present invention and rotated with the maximum centrifugal acceleration of 5,000 Xg or more, it is possible to realize a high recovery percentage. In addition, since a micro-plate can be used, it is possible to treat a large number of specimens at one time. It is consequently possible to improve the efficiency in centrifugal separation process.

According to the present invention, the back bottom surface of a sample injection hole portion of a micro-plate is received by an adapter, so that it is possible to put the micro-plate including a sample under centrifugal acceleration higher than conventional one.

According to the present invention, the collective of the micro-plates or micro-plate-like micro-tubes can be rotated under high centrifugal acceleration so that the efficiency in the centrifugal separation process is high.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A micro-plate adapter for mounting a micro-plate onto a centrifugal separator rotor, micro-plate having a sample injection hole portion for containing a sample therein and an external wall extending below a back bottom surface of said sample injection hole portion, said adapter comprising:

a bottom surface extending beyond a periphery of said micro-plate; and a bearing surface for contacting said back bottom surface of said sample injection hole portion, wherein said bearing surface extends above said bottom surface to an extent greater than or equal to the extent that said external wall extends below said back bottom surface of said sample injection hole portion, wherein said bearing surface is provided on a pad which is a separate part from said adapter, and wherein said pad is provided with a plate pressing portion for restricting movement of said micro-plate.

2. A micro-plate adapter according to claim 1, wherein said pad includes an outer circumference, and said plate pressing portion is located adjacent the outer circumference of said pad.

3. A micro-plate adapter according to claim 1, wherein said plate pressing portion extends upward from the periphery of said pad for contacting the external wall.

4. A micro-plate adapter according to claim 3, wherein said plate pressing portion extends from said pad to a greater extent than does said bearing surface.

5. micro-plate adapter for mounting a micro-plate onto a centrifugal separator rotor, said micro-plate having a sample injection hole portion for containing a sample therein and an external wall, said adapter comprising:

a bearing surface for contacting a back bottom surface of said sample injection hole portion, wherein a step portion equal to or larger than a difference between the back bottom surface of said sample injection hole portion of said micro-plate and a height of said external wall is provided in an outer circumference of said bearing surface.

6. A micro-plate adapter according to claim 5, wherein said bearing surface is provided on a pad which is a separate part from said adapter.

7. A micro-plate adapter for mounting a micro-plate onto a centrifugal separator rotor, said micro-plate having a sample injection hole portion for containing a sample therein and an external wall, said adapter comprising:

a bearing surface for contacting a back bottom surface of said sample injection hole portion, wherein said bearing surface is provided on a pad which is a separate part from said adapter, and a pad concave portion substantially equal in size to an upper surface of said micro-plate is provided in a lower surface of said pad.

* * * * *